United States Patent [19]

Tabler et al.

[11] 4,431,523

[45] Feb. 14, 1984

[54] UPGRADING FUEL FRACTIONS IN A RE-REFINED OIL PROCESS

[75] Inventors: Donald C. Tabler; Jerald A. Howell, both of Bartlesville, Okla.

[73] Assignee: Phillips Petroleum Company, Bartlesville, Okla.

[21] Appl. No.: 507,400

[22] Filed: Jun. 24, 1983

[51] Int. Cl.[3] ..... C10M 11/00

[52] U.S. Cl. ..... 208/182; 208/184

[58] Field of Search ..... 208/182, 184

[56] References Cited

U.S. PATENT DOCUMENTS

| | | | |
|---|---|---|---|
| 3,930,988 | 1/1976 | Johnson | 208/182 |
| 4,151,072 | 4/1979 | Nowack et al. | 208/182 |
| 4,247,389 | 1/1981 | Johnson et al. | 208/182 |
| 4,287,049 | 9/1981 | Tabler et al. | 208/180 |

*Primary Examiner*—Delbert E. Gantz
*Assistant Examiner*—Helane E. Maull

[57] ABSTRACT

In a process for the re-refinement of used lubricating oil containing fuel fraction, an upgraded fuel fraction is provided by combining fuel fraction with demetallized lubricating oil prior to the hydrotreatment stage.

3 Claims, 1 Drawing Figure

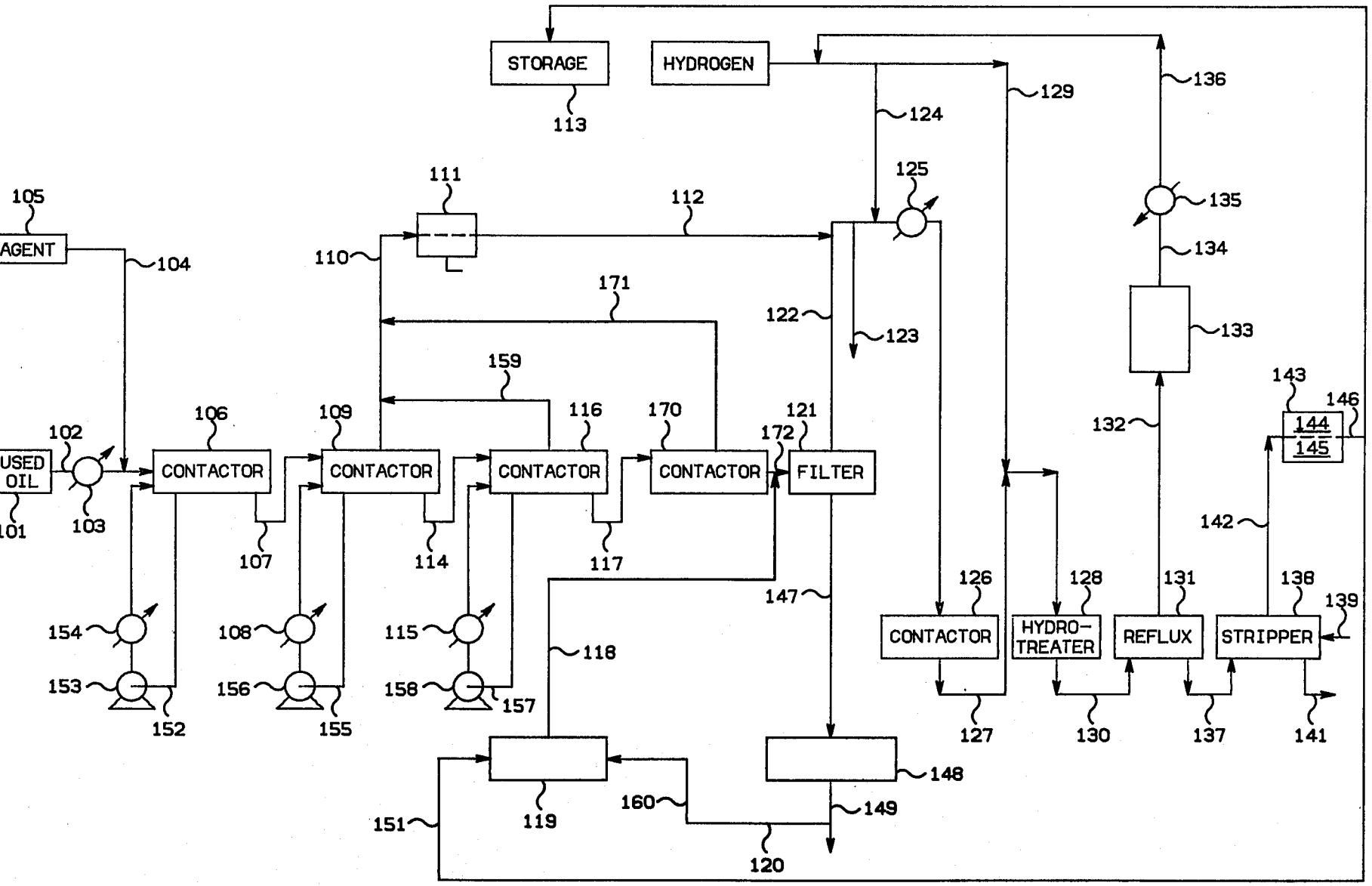
USED OIL
AGENT
CONTACTOR
CONTACTOR
CONTACTOR
CONTACTOR
CONTACTOR
FILTER
HYDROGEN
STORAGE
HYDRO-TREATER
REFLUX
STRIPPER
CONTACTOR
144
145

UPGRADING FUEL FRACTIONS IN A RE-REFINED OIL PROCESS

This invention relates to a process for upgrading fuel fractions contained in used oils.

It is known that used oils usually contain substantial quantities of light or lower boiling hydrocarbon fractions averaging 10 to 15 volume percent of oil. These lower boiling hydrocarbon fractions are commonly called "fuel" fractions.

In some processes for the re-refinement of used oils, for example as disclosed in U.S. Pat. No. 4,287,049, part of this fuel fraction is removed during the process. Such fuel fractions are rather impure, odoriferous and emulsion forming. In such conditions, these fuel fractions have no economical or commercial value. Therefore, a process which upgrades such fuel fractions would be highly desirable.

It is therefore an object of this invention to provide an improved process for the re-refinement of used oil containing fuel fractions wherein the fuel fraction is substantially upgraded.

Other aspects, objects, and the several advantages of the present invention are apparent from the specification, claims and appended drawing which is a schematic representation of the process of the invention.

In accordance with the present invention, we have discovered that the fuel fraction initially contained in a used lubricating oil can be substantially upgraded by combining the fuel fraction with demetallized used oil and thereafter hydrotreating the resulting combination.

More specifically, in accordance with the present invention, we have discovered that in an integrated process for the production of an essentially pure lube oil stock from a used lubricating oil containing a fuel fraction which comprises the steps of (a) contacting the used lubricating oil containing fuel fraction with an aqueous solution of a treating agent consisting essentially of an ammonium salt under conditions of temperature, pressure, and time sufficient to disperse the agent in the used lubricating oil and to react the agent with the ash-forming components of the used oil; (b) removing a major portion of water and fuel fraction from the resulting aqueous reaction mixture from step (a); (c) separating the oil phase from the residual mixture consisting essentially of used lubricating oil and reacted treating agent resulting from step (b); (d) heating the resulting demetallized oil from step (c) to a temperature in the range of 200° C. to 480° C.; (e) contacting the resulting heated oil from step (d) with at least one adsorbent selected from the group consisting of activated carbon, silica, gel, clay, bauxite, and alumina in a contacting zone, (f) hydrotreating the resulting oil from step (e); (g) stripping the resulting hydrotreated oil from step (f); (h) thereafter recovering the resulting stripped oil as a product of the process; and (i) thereafter recovering a fuel fraction as a product of the process, that the fuel fraction is upgraded by separating the fuel fraction and water from step (b) and thereafter, combining the separated fuel fraction with the separated oil from step (c) prior to hydrotreatment in step (f).

In the context of the present invention, the term "demetallized oil" as used herein is defined as that oil which has been treated to be substantially free of ash forming components and metal contaminants such as lead, zinc, barium, calcium, phosphorus, and iron.

The demetallized oil is typically derived from used lubricating oils. "Used lubricating oils" as used herein refers to the discarded oils that have been used for internal combustion lubrication purposes such as crankcase oils, e.g., in gasoline engines or diesel engines. Other sources of used oils include steam-turbine oils, transmission and gear oils, steam-engine oils, hydraulic oils, heat-transfer oils and the like.

The oils used for the purposes named above are the refined lubricating cuts from paraffin-base, mixed-base, or naphthenic crudes. Their viscosities are generally in the range of from about 100 to 1800 SUS at 100° F. (37.8° C.). The oils also contain various additives such as oxidation inhibitors (i.e., barium, calcium, and zinc alkyl thiophosphates, di-t-butyl-p-cresol, etc.), antiwear agents (i.e., organic lead compounds such as lead diorganophosphorodithioates, zinc dialkyldithiophosphates, etc.), dispersants (i.e., calcium and barium sulfonates and phenoxides, etc.), rust inhibitors (i.e., calcium and sodium sulfonates, etc.), viscosity index improvers, (i.e., polyisobutylenes, poly-alkylstyrenes, etc.), detergents (i.e., calcium and barium salts of alkyl benzene sulfonic acids and ashless type detergents such as alkyl-substituted succinimides, etc.).

The ammonium salt treating agents which are useful in the process of the present invention are those selected from the group consisting of ammonium sulfate, ammonium bisulfate, ammonium phosphate, diammonium hydrogen phosphate, ammonium dihydrogen phosphate, as well as mixtures thereof. At present, diammonium hydrogen phosphate is the preferred treating agent.

In addition, if desired, precursors of said ammonium salts can be employed instead of part for all of the ammonium salt. Some examples of these precursors include ammonium thiosulfate, ammonium polyphosphates such as ammonium metaphosphate, urea sulfate, guanidine sulfate, urea phosphate, and guanidine phosphate. Other applicable precursors include reactive combinations of ammonium and/or ammonium hydroxide with sulfuric acid and/or phosphoric acid and/or an ammonium hydrogen sulfate or phosphate, i.e., ammonium bisulfate , diammonium hydrogen phosphate, and/or ammonium dihydrogen phosphate. When the precursor comprises a combination of such components reactive with each other to give the desired salt in situ, the components of the combination can be introduced at the same time, or either component can be added prior to the introduction of the other component.

Although the concentration of treating agent in the aqueous solution of treating agent is not critical and more dilute solutions can be used, the economics of the process are enhanced by the use of relatively concentrated solutions in order that the amount of water to be removed subsequently will not be great. Generally the concentration of treating agent in the aqueous solution will be within the range of about 30 to about 95 weight percent, typically about 80 weight percent, of that in an aqueous solution at 25° C. saturated with the treating agent. Frequently some water will be found in used oil, and in these instances the concentration of the treating agent can be adjusted accordingly.

In the process of this invention, the treating agent should be employed in an amount at least sufficient to react with all of the metal constituents in the used oil. Although the weight ratio of the treating agent to the used oil can vary greatly, depending in part upon the nature and concentration of metal-containing components in the oil and on the particular treating agent employed, it generally will be within the range of about 0.002:1 to about 0.05:1, most often being within the range of about 0.005:1 to about 0.015:1, and typically being about 0.01:1. Although larger amounts of treating agent can be used, in most instances this would be wasteful of treating agent.

Fuel fraction and water can be removed from the mixture resulting from the combination of the aqueous solution and the oil by any suitable means. Distillation is the preferred method of removing water. Generally, the distillation is carried out at a temperature in the range of about 100° to about 140° C. and a pressure in the range of about 5 to about 25 psig for a period of time sufficient to effect removal of a major portion of the water.

The solids are separated from the product of step (b) by any suitable method such as filtration or centrifugation. Generally, it is desirable to use a filter aid in the separation process. Filter aids which are useful in the practice of this invention include those selected from the group consisting of diatomaceous earth, perlite, and cellulose fibers. Presently preferred is diatomaceous earth.

The separated or filtered oil (demetalized) resulting from step (c) is then admixed with the fuel fraction. However, it is within the scope of the present invention that the fuel fraction may also be admixed with the oil phase prior to separation of the solids from the oil phase.

The mixture of separated used lubricating oil and fuel fraction is then passed through an absorbent before hydrotreating to remove polar compounds present in the used lubricating oil. The oil can be contacted with a suitable adsorbent under conditions sufficient to effectively remove polar compounds which can include oxygen-, nitrogen-, and sulfur-containing compounds, as well as other polar materials. The conditions of contacting with an absorbent will generally be in the range of 0 to 1000 psig and a temperature of 300° F. to 760° F. (149° C.–404° C.). Suitable absorbents include at least one of activated clay, silica gel, alumina, and the like.

Subsequently, the mixture is hydrotreated to remove polar compounds and unsaturated compounds. The conditions include temperatures in the range of 500° F. to 800° F. (260°–427° C.) and pressures in the range of 150 to 3000 psig in the presence of hydrogen in an amount sufficient to effectively remove the undesirable constituents present in the oil. Suitable hydrogenation catalysts include nickel-molybdenum sulfide on alumina, cobalt molybdate, tungsten-nickel sulfide on alumina, and the like.

Following hydrotreating, the mixture of oil and fuel fraction is passed to a separator, typically a stripper, to remove the fuel fraction (i.e., light hydrocarbons) overhead. Steam stripping is the usual mode with gas stripping available as an alternative.

To illustrate further the overall process of the present invention, the following description is provided which, taken in conjunction with the attached drawing which is a schematic representation of the process, sets forth the presently preferred mode of operation.

As shown in the drawing, used oil-containing fuel fraction from storage tank 101 is passed via line 102 to heater 103 and contactor 106. Aqueous treating agent containing diammonium hydrogen phosphate from makeup tank 105 is introduced via line 104. If desired, agent precursors ammonia, phosphoric acid, and water can be introduced into the heated oil downstream of heater 103, thereby forming the treating agent in situ in line 102 and contactor 106. The oil from heater 103 is passed in admixture with treating agent into the first agitated contactor 106 wherein the mixture is maintained under agitation for a time sufficient to react with the ash-forming components in the oil. Preferably, a recycle stream is passed through conduit 152 to pump 153 and then through heater 154 before its return to contactor 106, thereby providing heat and agitation to the contents of the contactor. Stirring means also can be employed.

Thereafter the mixture is passed via conduit 107 to second contactor 109, which is maintained at a temperature in the range of about 110° to about 140° C. for a time sufficient to effect distillation of a major portion of the water and at least some of the fuel fraction present therein. Thus, while retained in contactor 109, essentially all of the water and at least a portion of the fuel fraction components of the mixture are removed via line 110 and passed to separator 111 wherein a fuel fraction layer and a water layer are allowed to form. The fuel fraction phase can then be transferred via line 112 to line 122. The water layer can be removed and discarded or employed for any desired purpose. Preferably, a recycle stream is passed through conduit 155 to pump 156 and then through heater 108 before its return to contactor 109, thereby providing heat and agitation to the contents of the reactor. Stirring means also can be employed.

The resulting residual mixture comprising a hot oil phase which is essentially free of water is passed via conduit 114 to a third contactor 116. Preferably, a recycle stream is passed through conduit 157 to pump 158 and then through heater 115 before its return to contactor 116, thereby providing heat and agitation to the contents of the contactor. Any residual water and fuel fraction components are removed from contactor 116 via line 159.

If desired, any one or two or all of contactors 106, 109 and 116 can be provided with jackets heated by steam or other source of heat to aid in maintaining the contents of the contactors at the desired temperatures. Any one or two or all of contactors 106, 109 and 116 can be equipped with stirrers to provide additional agitation. In an operable but presently less preferred arrangement, a stirrer in any one or more of the three contactors can be used instead of the recycle system employed with the corresponding one or more of the three contactors, any additional heating being provided by heaters in the line ahead of the contactors and/or by heated jackets around the contactors. Also, if desired, any one or two or all of conduits 102, 107 and 114 can feed into the recycle stream for contactors 106, 109 and 116, respectively, i.e., into conduits 152, 155 and 157, respectively, instead of directly into the respective contactor as shown in the drawing.

The resulting hot mixture is passed via line 117 to contactor 170 wherein it is subject to agitation at a temperature in the range of about 600°–650° F. thereby resulting in a product which when later filtered will contain less ash than it would contain if it had been so treated. Any additional residual water and fuel fraction present are removed from contactor 170 via line 171. The treated oil is then passed from contactor 170 via line 172 to filter 121 which optionally can be precoated with diatomaceous earth. If desired, other filter aids such as perlite or cellulose fibers can be used. Diatomaceous earth is passed through conduit 118 from makeup tank 119 into conduit 172 from which the resulting mixture comprising oil, solid impurities and diatomaceous earth is passed directly to filter 121.

Filter cake from filter 121 is removed via line 147 and optionally passed to furnace 148 from which, following burning or calcination, at least a portion of the resulting ash comprising diatomaceous earth can be passed to waste via line 149 or recycled via conduits 120 and 160 to slurry makeup tank 119 for further use in the system. Fresh diatomaceous earth is added through conduit 160. Light hydrocarbons for use in preparing the slurry can be recovered from the integrated process and can be passed to tank 119 via conduit 151.

In carrying out the process of this embodiment of the invention, a beneficial increase is achieved in the filter rate of the oil through filter 121 when the oil-reagent mix is maintained in admixture for a period of at least 10 minutes at a temperature of 60° to 120° C. prior to further processing.

Thus the hot filtered oil, being essentially free of ash-forming constituents previously contained therein, is suitable for a variety of industrial uses and, if desired, can be removed from the system via line 123.

However, in the integrated process of this invention, the hot oil following filtration is admixed with the fuel fraction via line 112 and the resulting mixture is passed via line 122 to heater 125 in order to raise the oil to a temperature in the range of 200° to 480° C. for further processing in a manner similar to that shown in the drawing. If desired, a first portion of hydrogen is added thereto via line 124. The resulting mixture containing the added hydrogen is then passed through contactor 126 wherein decomposition is effected of the sulfonates contained in the oil.

While it is presently preferred that contactor 126 contain bauxite or an activated carbon adsorbent bed therein, this unit can employ other absorbents such as those selected from the group consisting of silica gel, clay, activated alumina, combinations thereof, and the like. The adsorbent serves to effect breakdown and decomposition of the ammonium salts of sulfonic acids and the ashless detergents contained in the oil. The adsorbent further serves to collect a small portion of the resulting products and thus precludes passage of such undesirable decomposition products to the hydrotreater. Such adsorbents can be regenerated by conventional means and reused.

While less preferred, it is also possible to omit contactor 126 and to remove the small amount of ash components and highly polar materials present in the low-ash, filtered oil by heating the oil to a temperature within the range of about 300°–410° C., e.g., about 380° C. in the presence of hydrogen and an adsorbent suspended in the oil. After such treatment, the oil is cooled to a temperature within the range of about 60°–200° C., e.g. about 150° C., and refiltered. The same adsorbents cited above for use in fixed-bed contactors are suitable for this contact-treating process and give similar results.

Preferably, the adsorbent contains about 0.2 to about 20 weight percent of at least one metal selected from the group consisting of Group VIB and Group VIII metals, this weight percent being based on the total weight of modified adsorbent. This modified adsorbent can be prepared by impregnation of the adsorbent with an aqueous solution of the water-soluble compound of a Group VIB or Group VIII metal, followed by evaporation of water. Water-soluble compounds presently preferred for this use are iron compounds such as ferric ammonium oxalate, ferric ammonium citrate, ferric sulfate, and ferrous ammonium sulfate.

The resulting treated mixture is thereafter passed from contactor 126 via line 127 to hydrotreater 128, which is maintained at an elevated temperature, which serves to effect destruction of the various additive systems previously added to the original oil stock. Hydrogen for the desired hydrotreating reaction is introduced to the system via line 129 in communication with line 127 or, if desired, directly to the hydrotreater 128.

In hydrotreater 128 the mixture is subjected to hydrogenation conditions in the presence of a catalyst sufficient to remove unwanted compounds and unsaturated materials and to effect decomposition of residual sulfur, oxygen and nitrogen bodies so as to yield an oil product suitable for further purification to a lube stock.

Suitable catalysts for use in hydrotreater 128 are those selected from the group consisting of Group VIB and Group VIII metals and combinations thereof, on a refractory support, used in conventional hydrodesulfurization process.

Following hydrotreating, the resulting mixture is passed via conduit 130 to separator-reflux column 131 which serves to remove water and various other by-products of the previous treatments from the oil. If desired, and particularly when HCl is present, water can be injected into column 131 to aid in removal of most of any HCl and part of the $H_2S$ and $NH_3$ as water-soluble salts. Overhead from column 131 comprising hydrogen, $H_2S$, $NH_3$, and water is passed via line 132 to sulfur removal unit 133. This unit, for example a bed of zinc oxide, serves to remove $H_2S$ (sulfur) from the hydrogen stream. The resulting sulfur-free hydrogen stream is thereafter passed via line 134 to cooler 135. Ammonia is then removed, for example by water washing in an ammonia removal unit (not shown) in conduit 136. Hydrogen is then recycled via conduit 136 to line 129.

An example of another material useful in unit 133 is iron oxide. Alternatively, a solvent process can be employed using substances such as alkanolamines and/or other amines, the $H_2S$ subsequently being oxidized to sulfur in a Claus-type process.

The bottoms product from column 131 is passed via line 137 to lube-stock stripper 138 wherein a further steam treatment is carried out by introduction of steam via line 139.

Stripping, preferably steam stripping, of the oil is essential to the integrated process of this invention since it serves to remove those light hydrocarbon products boiling below the oil, such as kerosene or heavy gasoline, which have remained entrained in the oil or which are by-products of the hydrogenation treatment. Alternatively, gas stripping such as with hydrogen can be employed.

The resulting hot stripped product, consisting essentially of a pure lube oil stock, following cooling such as by use in heat exchanger 125, is thereafter passed via line 141 to a lube oil stock product tank (not shown) for storage and subsequent use as an additive-free lube oil stock suitable for reformulation with additives as desired.

Overhead from stripper 138, which consists essentially of fuel fraction and water is passed via line 142 to settler 143, where a fuel fraction phase 144 and a water layer 145 are allowed to form. The fuel fraction layer 144 is removed via line 146 and if desired, moved to storage tank 113 for further use or recycled to filter aid makeup tank 119 via line 151. The small amount of gases present in line 146 can be removed by flashing.

Depending upon the feedstock, treating agent and other characteristics of a particular operation, as one skilled in the art in possession of this disclosure will understand, the specific conditions of operation given below can vary, preferably within the approximate ranges which are also given.

| FIG. 1 Ref. No. | Unit Description | Calculated Operation Typical | Approximate Preferred Ranges |
|---|---|---|---|
| 103 | Heater | Temperature 95° C.<br>Pressure 17 psia | α°-120° C.<br>atmospheric-250 psia |
| 104 | Treating Agent | Weight ratio agt:oil 0.01:1 | 0.005:1-0.05:1 |
| 106 | Contactor | Temperature 95° C.<br>Pressure 17 psia<br>Time 30 minutes | 60°-120° C.<br>atmospheric-50 psia<br>10 minutes-2 hours |
| 109 | Contractor | Temperature 125° C.<br>Pressure 16 psia<br>Time 30 minutes | 110°-140° C.<br>5-25 psia<br>10 minutes-2 hours |
| 116 | Contactor | Temperature 160° C.<br>Pressure 16 psia<br>Time 30 minutes | 140°-200° C.<br>5-25 psia<br>10 minutes-2 hours |
| 111 | Phase Separator | Temperature 40° C.<br>Pressure atmospheric | 0°-80° C.<br>atmospheric-45 psia |
| 17O | Contactor | Temperature 360° C.<br>Pressure 40 psia<br>Time 30 minutes | 320-420° C.<br>atmospheric-100 psia<br>5 minutes-2 hours |
| 121 | Filter | Temperature 115° C.<br>Pressure differential | 60°-200° C. |
| | | Plate and frame filter 80 psi | 5-100 psi |
| | | Continuous rotary drum filter 10 psi | 2-14 psi |
| 148 | Furnace | Temperature 760° C.<br>Pressure atmospheric | 650°-870° C.<br>substantially atmospheric |
| 118 | Filter Aid | Weight ratio aid:oil 0.01:1 | 0:1-0.15:1 |
| 124 | Hydrogen Charge | 111 vol/vol oil | 80-3000 vol/vol oil |
| 125 | Heater | Temperature 370° C.<br>Pressure 735 psia | 200°-480° C.<br>150-3000 psia |
| 126 | Contactor | Temperature 370° C.<br>Pressure 735 psia | 200°-480° C.<br>150-3000 psia |
| 128 | Hydrotreater | Temperature 360° C.<br>Pressure 730 psia | 200°-430° C.<br>150-3000 psia |
| 129 | Hydrogen Charge | 222 vol/vol oil | 80-3000 vol/vol oil |
| 131 | Reflux | Temperature 325° C.<br>Pressure 705 psia | 290°-400° C.<br>600-800 psia |
| 133 | Sulfur Removal Unit | Temperature 290° C.<br>Pressure 700 psia | 150°-430° C.<br>100-3000 psia |
| 135 | Cooler | Inlet temperature 290° C.<br>Outlet temperature 55° C. | 260°-370° C.<br>40°-95° C. |
| 138 | Stripper | Temperature 370° C.<br>Pressure 20 psia | 280°-395° C.<br>atmospheric-50 psia |
| 143 | Settler | Temperature 55° C.<br>Pressure 16 psia | 0°-80° C.<br>atmospheric-45 psia |

The following Example illustrates the benefits obtained by the present invention.

EXAMPLE

This Example illustrates the advantages achieved in the present invention by combining a relatively impure fuel fraction with demetallized oil and thereafter hydrotreating the resulting combination.

247 lbs. of demetallized oil from used lubricating oils were collected and combined with 145 lbs. of overhead fuel fraction obtained from contactors in which demetallization occurred (i.e., contactors 109, 116, and 170 in the drawing). The X-ray analysis of the 145 lbs. of fuel fraction is given in Table I.

The resulting combination of fuel fraction and demetallized oil was passed over a clay guard bed (such as contactor 126) then passed to a fixed bed hydrotreater (such as hydrotreater 128) containing Filtrol RHPC-1 catalyst, the following conditions being present: LHSV-1.0 gal/hr per gal catalyst; T=690° F., Pressure: 700 psig; Hydrogen rate: 1800 scf/bbl. (Filtrol RHPC-1 contains about 2.2 wt.% Ni and 7.7 wt.% Mo on alumina of average pore volume 150 Angstroms. RHPC-1 is commercially availabe from Filtrol Corporation, Los Angeles, Calif.).

Following hydrotreatment, the hydrotreated combination of oil and fuel fraction was vacuum distilled to recover fuel fraction (boiling point in the range of from about 240° F. to 650° F.). The fuel fraction was then analyzed by X-ray, the results obtained are listed in Table I:

TABLE I

ANALYSIS OF FUEL FRACTION

| Ingredient (ppm) | Before Hydrotreatment | After Hydrotreatment |
|---|---|---|
| S | 4200 ppm | 160 ppm |
| N | 854 ppm | 89 ppm |
| Cl | 1785 ppm | 77 ppm |
| Polychlorinated Biphenyls (PCB) | 50 ppm | <5 ppm |
| Color* | >8.0 (virtually opaque) | <0.5 (virtually water white) |
| Odor | very odoriferous virtually no odor | |

*Measured by ASTM D-1500

The above data indicate a substantial reduction of S, N, Cl, and PCB content of the fuel fraction following hydrotreatment of the fuel fraction in combination with demetalyzed used oil. Furthermore, the color of the fuel fraction was substantially improved. It was readily apparent that the hydrotreated fuel fraction was virtually odorless as compared to its highly odoriferous nature before hydrotreatment.

In conclusion, the data demonstrate that the inventive process results in a substantially upgraded fuel fraction.

It is noted that the preceding description is directed to illustrative embodiments of the present invention. Obviously, there are many variations and modifications that can be made without departing from the spirit and scope of the present invention.

We claim:

1. In a proces for the re-refinement of used lubricating oils containing fuel fractions which comprises the steps of:

(a) contacting said used lubricating oil with an aqueous solution of a treating agent consisting essentially of an ammonium salt selected from the group consisting of ammonium sulfate, ammonium bisulfate, ammonium phosphate, diammonium hydrogen phosphate, ammonium dihydrogen phosphate and mixtures thereof, said treating agent being present in an amount at least sufficient to react with essentially all of the metal constituents in said used lubricating oil, wherein said contacting is carried out at a temperature in the range of from 60° to 120° C. and a pressure in the range of 1 atmosphere to 250 psia and wherein said agent is kept in contact with said used lubricating oil for a time sufficient to disperse said agent in said used lubricating oil and to react said agent with essentially all the ash-forming metal components of said used lubricating oil;

(b) removing a major portion of water and fuel fraction components from the resulting aqueous reaction mixture from step (a) by maintaining said mixture at a temperature in the range of 110° to 140° C. and a pressure in the range of 5 to 25 psia for a period of time sufficient to effect removal of a major portion of water and light hydrocarbons therefrom;

(c) separating the oil phase from the residual mixture consisting essentially of used lubricating oil and reacted treating agent resulting from step (b);

(d) heating the resulting separated oil from step (c) to a temperature in the range of 200° to 480° C.;

(e) contacting the resulting heated oil from step (d) with at least one adsorbent selected from the group consisting of activated carbon, silica gel, clay, bauxite and alumina in a contacting zone;

(f) hydrotreating the resulting oil from step (e) by contacting said oil with hydrogen and a hydrotreating catalyst at a temperature in the range of 200° to 430° C. and at a pressure in the range of 150 to 3000 psia;

(g) stripping the resulting hydrotreated oil from step (f) in a stripping zone maintained at a temperature in the range of about 280° to 395° C. and at a pressure in the range of atmospheric to 50 psia; and thereafter (h) recovering the resulting stripped oil from said stripping zone as a product of the process; and (i) recovering a fuel fraction from said stripping zone as a product of the process; the improvement which comprises separating the fuel fraction and water and thereafter combining the separated fuel fraction with the separated oil prior to hydrotreatment.

2. A process according to claim 1 wherein said separated fuel fraction and said separated oil are combined prior to heating in step 1(d).

3. A process according to claim 1 wherein said fuel fraction and said separated oil are combined prior to contacting with said adsorbent in step 1(e).

* * * * *